US005271458A

United States Patent [19]

Yamamoto et al.

[11] Patent Number: 5,271,458

[45] Date of Patent: Dec. 21, 1993

[54] CORRUGATED LOUVER FIN TYPE HEAT EXCHANGING DEVICE

[75] Inventors: Michiyasu Yamamoto, Chiryu; Mikio Fukuoka, Bisai, both of Japan

[73] Assignee: Nippondenso Co., Ltd., Kariya, Japan

[21] Appl. No.: 960,322

[22] Filed: Oct. 13, 1992

[30] Foreign Application Priority Data

Oct. 18, 1991 [JP] Japan ..... 3-270855

[51] Int. Cl.[5] ..... F28D 1/02; F28F 1/22

[52] U.S. Cl. ..... 165/152; 165/153; 165/183; 29/890.046

[58] Field of Search ..... 165/152, 153, 183; 29/890.046

[56] References Cited

U.S. PATENT DOCUMENTS 4,332,293 6/1982 Hiramatsu ..... 165/153
4,420.039 12/1983 Dubrovsky ..... 165/152
4,892,143 1/1990 Ishii ..... 165/152

FOREIGN PATENT DOCUMENTS 61892 3/1988 Japan ..... 165/152
1-23996 5/1989 Japan ..... 165/152

*Primary Examiner*—John Rivell
*Assistant Examiner*—L. R. Leo
*Attorney, Agent, or Firm*—Cushman, Darby & Cushman

[57] ABSTRACT

A large value of the radius R of the curved portion 110 of a corrugated fin 101 allows fillet portion 104 to have a large length along the length of the pipe 102 for decreasing the heat resistance between the pipe 102 and the fin 101, which makes the length of the louver portions 103 small. Contrary to this, a small value of the radius R of the curved portion 110 of a corrugated fin 101 allows louver portions 103 to have a large length, which is formed on the straight portion of the fin for increasing the heat transfer efficiency from the louver, which causes, however, the length of the fillet to be shortened. Best matching was obtained for decreasing the heat resistance and increasing the heat transfer efficiency when the radius of the curved portion is selected in a range between 0.14 mm to 0.37 mm.

10 Claims, 8 Drawing Sheets

CORRUGATED LOUVER FIN TYPE HEAT EXCHANGING DEVICE

BACKGROUND OF THE INVENTION

1. Field of the Invention

The present invention relates to a corrugated louver fin type heat exchanging device.

2. Description of Related Art

Japanese Unexamined Patent Publication No. 63-61892 discloses a corrugated louver fin type heat exchanging device which has a plurality of flattened heat exchanging pipes having flat surfaces which face each other in parallel, and corrugated fins which extend along the length and width thereof are arranged between the adjacent pipes along the direction of the length and width thereof, each corrugated fin having straight portions and bent portions which are arranged alternately to obtain a corrugated shape along the length of the fin, the straight portions forming a flat plate portion along the width of the fin, which is cut and raised to obtain a plurality of spaced louvers, the bent portions having ends connected to the flat surfaces of the heat exchanging pipes by means of soldering.

SUMMARY OF THE INVENTION

An object of the present invention is to provide a corrugated louvered fin type heat exchanging device, capable of obtaining an increased heat exchanging efficiency.

According to the present invention, a heat exchanging apparatus is provided, comprising:

a plurality of heat exchanging pipes having flat surfaces which are spaced in parallel and face each other between adjacent pipes, the heat exchanging pipes being for passing a first fluid medium;

corrugated fins arranged between the faced flat surface of the heat exchanging pipes, the corrugated fin being for making contact with a second fluid medium so that a heat exchange takes place between the first fluid passing through the heat exchanging pipe and the second fluid contacting the fins, the corrugated fin extending along the length and width of the pipes, each of the corrugated fins having curved portions and straight portions along the length of the pipes, which are arranged alternately, so that the curved portions make contact with the flat surface of the heat exchanging pipes, the straight portion defining along the width of the pipes a plate portion which forms a plurality of spaced louvers as raised cut portions, and;

fillet portions made as soldering material for rigidly connecting the curved portions with corresponding flat surfaces of the heat exchanging pipes;

each of the louver portions extending along substantially the full length of the straight portion between the adjacent, opposite curved portions;

the curved portions having a radius of a value in a range between about 0.14 mm and about 0.37 mm.

BRIEF DESCRIPTION OF ATTACHED DRAWINGS

DESCRIPTION OF PREFERRED EMBODIMENTS

Figure 1:
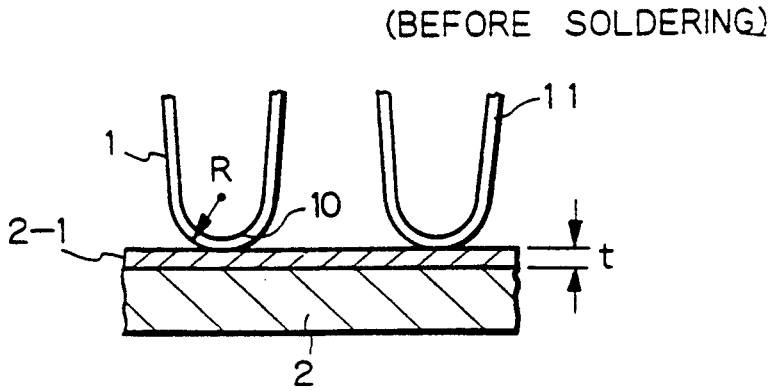
PRIOR ART Fig. 1
FIG. 1 shows an arrangement between corrugated fins and a flattened heat exchanging pipe before they are connected with each other.
Figure 2:
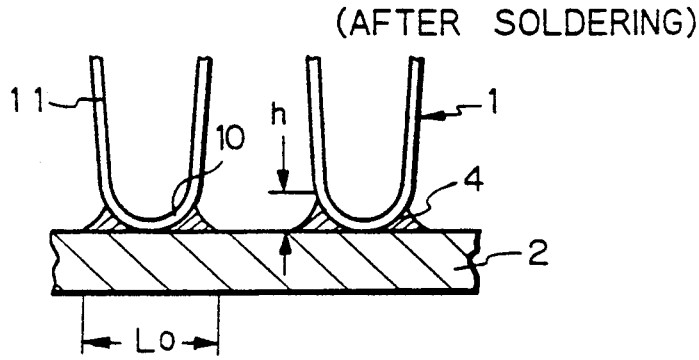
PRIOR ART Fig. 2
FIG. 2 is similar to FIG. 1 but after the connection of the fins and heat exchanging pipe.
Figure 3:
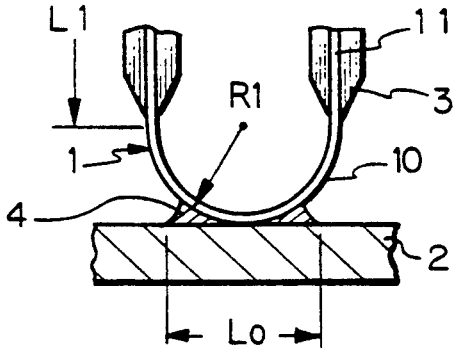
PRIOR ART Fig. 3
FIG. 3 shows partially the heat exchanging apparatus in a prior art where a curved portion has a large radius.
Figure 4:
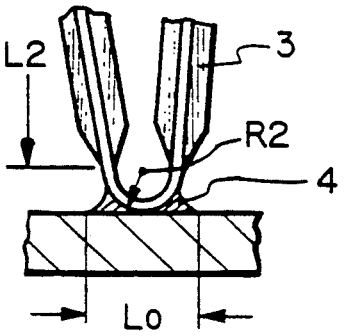
PRIOR ART Fig. 4
FIG. 4 shows partially the heat exchanging apparatus in a prior art where a curved portion has a small radius.
Figure 5:
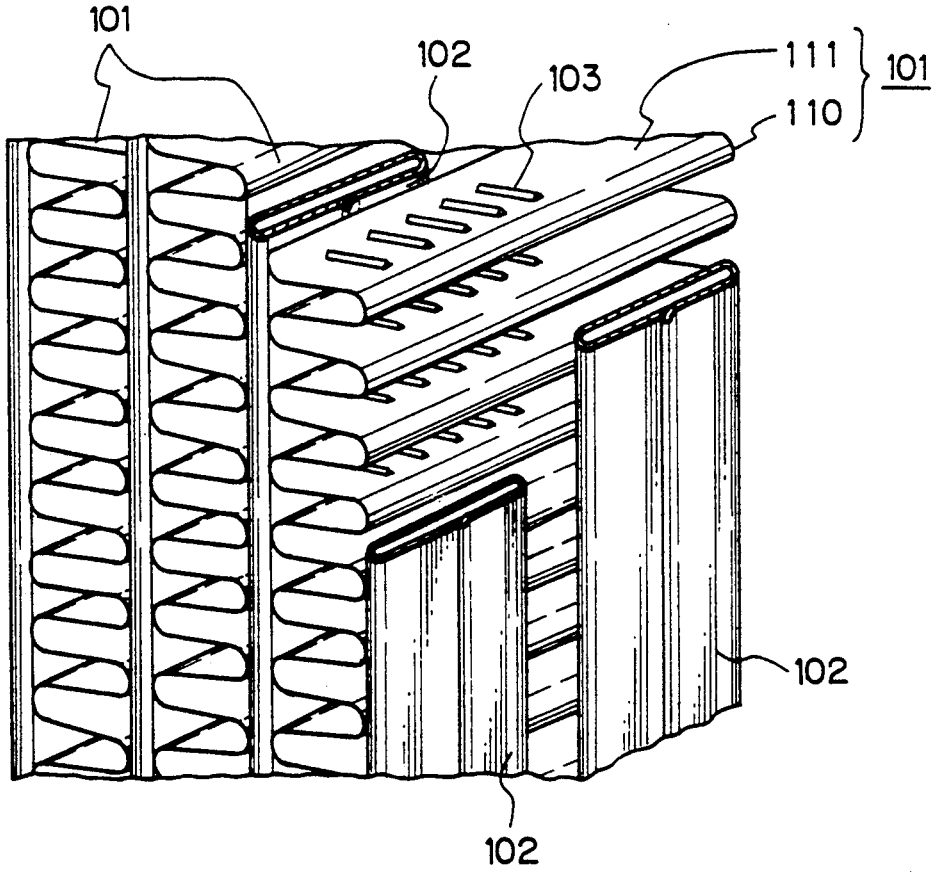
FIG. 5 is a schematic perspective construction of the heat exchanging apparatus according to the present invention.

Now, the problem to be solved by the present invention will described with reference to FIGS. 1 and 2, which shows schematically the construction of the prior art, Japanese Unexamined Patent Publication No. 63-61892. FIG. 1 shows the arrangement prior to the connection of a corrugated fin 1 to a heat exchanging pipe 2. The heat exchanging pipe 2 is, on its flat surface, coated with a layer 2-1 of a soldering material. The corrugated fin 1 and heat exchanging pipe 2 are pressed against each other while they are subjected to a heating, so that the soldering material clad on the outer flat surface of the heat exchanging pipe 2 is melted. The melted soldering material is, by capillary action, gathered to the area around the position where the corrugated fin 1 and the heat exchanging pipe are in contact, so that the soldering material fills outwardly widened throat formed between the bent portions 10 of the fin and the flattened surface of the heat exchanging pipe 2. The soldering material filling the throat after solidifying is called a fillet portion 4 (FIG. 2). As shown in FIGS. 3, 4 and 5, the straight portion 11 forms, along the width of the fin, a flat plate portion which is, at spaced positions, parallel, slitted and raised to obtain louvers for enhancing the cooling effect. Generally, the thickness t of the layer 2-1 (FIG. 1) of the soldering material is in a range between 10 to 40 μm, the radius R of the bent portion 10 is in a range between 0.4 to 0.7 mm, for example, 0.54 mm, the length $L_0$ of the fillet portion 4 is in a range between 0.6 to 1.3 mm, and the height, h of the fillet portion 4 is in a range between 0.1 to 0.3 mm.

FIGS. 3 and 4 show, respectively, constructions in the prior art heat exchanging devices, focused at a connection of the corrugated fin to the flattened surface of the heat exchanging pipe 2. In FIG. 3, the bent portion 10 has a radius R1. Contrary to this, in FIG. 4, the bent portion has a radius R2 smaller than that shown in FIG. 3.

The radius R of the bent portion 10 of the corrugated fin 1 can be decreased so that length of the straight portion 11 is increased, which allows the area of the louvers 3 on the straight portion 11 to be increased, which can improve a heat emission performance at the louvers, thereby enhancing the heat transfer efficiency of the heat exchanging apparatus. The louver 3 in FIG. 3 having a bent portion 10 of a radius of R1 has a length of L1 of the straight portion, and the louver 3 in FIG. 4 having a bent portion 10 of a radius of R2 (<R1) has a length L2 of a straight portion. In this case, the length L2 of the louver in FIG. 4 is longer than the length L1 of the louver in FIG. 3 for a length of $2\times(R1-R2)$.

However, according to the calculations and tests performed by the inventor, it was found that a reduction in the radius of the bent portion 10 of the fin 1 may decrease heat transfer performance.

Figure 6:
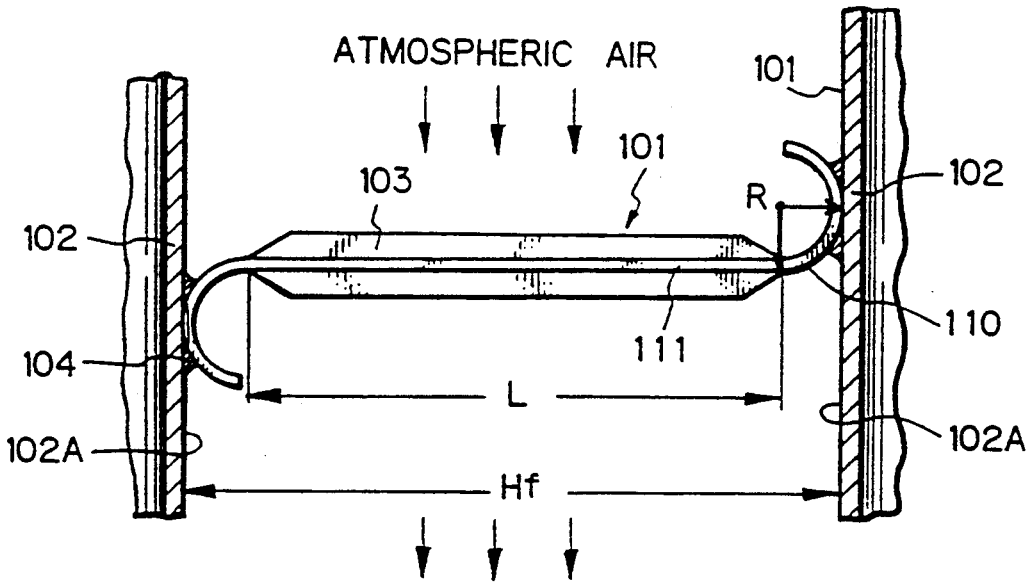
FIG. 6 is an enlarged partial view of the heat exchanging apparatus according to the present invention.

FIG. 5 generally illustrates the construction of the heat exchanging apparatus according to the present invention. A plurality of flattened heat exchanging pipes 102 made from aluminum based alloy material are arranged so that they are vertically spaced apart so that a plurality of rows of the pipes 102 are created vertically spaced apart. Corrugated fins 101 are made also from an aluminum based alloy sheet which is subjected to a stamping process by means of shaping rollers. The thus obtained corrugated fins 101 are arranged between adjacent rows of the heat exchanging pipes 102. Each of the corrugated fins 101 are constructed by a straight (or flat) portion 111 and curved end portions 110 which are alternately arranged along the vertical direction of the fins 101. The straight portion 111 forms, as easily seen from FIG. 5, a flat plate portion along the width of the fin 101, on which horizontally spaced louver portions 103 are formed. As shown in FIG. 6, each straight portion 111 of the fins 101 extends horizontally between opposite flat surfaces 102A of heat exchanging pipes 102 which are adjacent to each other. Fillet portions 104 made of the soldering material are created at each throat portion formed around the porions where the curved ends portion 110 are in contact with the flat surfaces 102A of the heat exchanging pipe 102. Namely, the heat exchanging pipe 102 is, on the flat surfaces 102A, formed with a coating (2-1 in FIG. 1) of the soldering material before its connection to the fins 101, and the corrugated fins 101 are brought into contact with the pipes 102 while they are heated, so that the soldering material is melted so that it is gathered by the effect of capillary action to throat areas located adjacent to portions where the curved end portions 110 and flat surfaces 102A of the pipes 102 are in contact with each other, thus forming the fillet portions 104.

The louver portions 103 which are spaced apart in parallel are formed along the entire width of the flat plate portion formed by the straight portions 111 along the length of the fin 101. In order to obtain the louver portions 103, the flat plate portions are slit and raised, so that the raised portions of the louver portions 103 are inclined with respect to the plane of the flat portions 111 of the fin 101. See FIG. 8. It should be noted that the height of the louver porions 103 is smaller than the half of the pitch in the length of the corrugated fin 101 (distance between the adjacent straight portions 111 of the fin 101) to prevent the longitudinally adjacent louver portions 103 from interfering with each other. The louver porions 103 can be obtained by a conventional cutting and bending shaper apparatus.

The curved end portion 110 of the corrugated fin 101 has a radius R of a value in a range between about 0.14 to about 0.37 mm, the thickness of the layer 2-1 of the soldering material is in a range between about 10 μm to about 40 μm, the length $L_0$ of the fillet portion 104 is in a range between about 0.6 mm to about 1.3 mm, and the height h of the fillet portion 104 is in a range between about 0.1 mm to about 0.3 mm. It should be noted that the radius R of the rounded end portion 110 of the fin 101 is measured at the outer surface thereof. Furthermore, the distance $H_f$ between the faced flat surfaces 102A of the adjacent heat exchanging pipes 102 is in a range between about 3 mm to about 10 mm, the thickness of the heat exchanging pipe 102 is in a range between about 0.09 to about 0.4 mm, and the angle $\theta$ of the louver portion 103 with respect to the general plane of the flat portion 111 of the fin 101, which corresponds to the height of the louver portion 103, is in a range between about 5° to about 30°.

Heat exchanging efficiency of the corrugated fin with louvers 103 according to the present invention will now be explained. The present invention basically relies on the fact that a large length L (FIG. 6) of a louver 103 can increase heat transfer efficiency due to the increased heat emission efficiency, and the fact that a large area of the fillet portion 104 can increase heat transfer efficiency due to an improved heat transfer efficiency to the fin 101 from the pipe 102 via the fillet portion 104. However, these two requirements, i.e., the increased louver length L and the increased fillet length, are contradictory to each other. Namely, the large area of the fillet portion 104 can be obtained through an increased radius R of the curved end portion 110 of the fin 101, which causes the length L of the flat portion 111 to be decreased.

Figure 7:
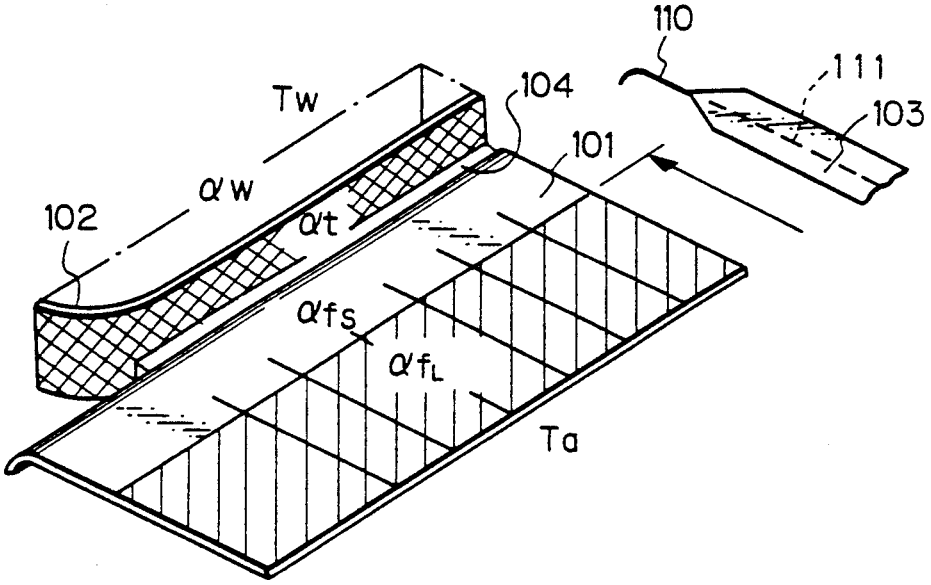
FIG. 7 shows a model of the heat exchange apparatus for theoretically analyzing the heat transfer operation.
Figure 8:
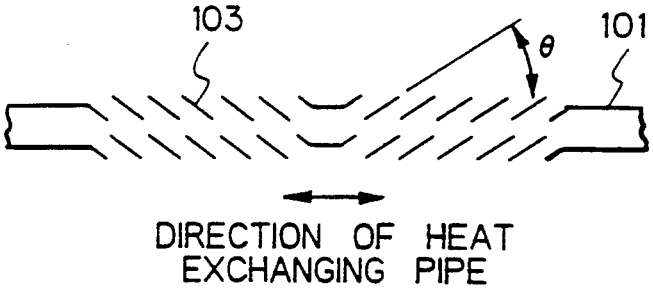
FIG. 8 is a schematic representation of the arrangement of louvers in a heat exchanging pipe in the apparatus in FIG. 6.

FIG. 7 shows a model for analyzing the mechanism of how a heat transmission takes place in an automobile, wherein engine cooling water is passed through the heat exchanging pipes 102 for cooling the engine cooling water by heat exchanging it with the atmosphere by flow contact with the fins 101. In FIG. 7, $\alpha_W$ is a ratio of heat transfer of the engine cooling water, which occurs between the water and the heat exchanging pipe 102. A heat resistance in the direction of the thickness of the heat exchanging pipe 2 is small and is therefore neglected hereinbelow. $\alpha_{fL}$ is a ratio of the heat transfer at the louver portion 103, which occurs between the straight portion 111 and the louver portion 103 and the atmosphere. $\alpha_{fS}$ is a ratio of the heat transfer at a non-louver portion, which occurs between the curved portion 110 and the atmosphere. $\alpha_t$ is a ratio of the heat transfer at the flat surface of the heat exchanging pipe 102, which occurs between the heat exchanging pipe 102 and the atmosphere. In this case, the engine cooling water temperature $T_W$ and the atmosphere temperature $T_a$ are presumed to be maintained to be constant. Furthermore, an assumption is made that the louvers 103 take the shapes as shown in FIG. 8, and a numerical difference analysis is carried out to obtain the value of the heat transfer ratio $\alpha_{fL}$ at the louver portion. The value of the heat transfer ratio $\alpha_{fS}$ at the non-louver portion and the value of the heat transfer ratio $\alpha_t$ at the flat surface of the heat exchanging pipe 102 are calculated from the laminar flow heat transfer at a flat plate, and the value of the heat transfer ratio $\alpha_W$ inside the heat exchanging pipe 102 is calculated based on a equation representing a turbulent flow in a circular pipe.

A finite elemental analysis for obtaining a steady state thermal analysis is carried out by inputting the above mentioned conditions, so that temperature distribution of various parts is calculated. At first, an amount of heat emission to the atmosphere $Q_a$ is obtained from equation (1), then the obtained heat emission amount $Q_a$ is divided by the temperature difference between the water temperature $T_W$ and the atmospheric temperature $T_a$ in order to obtain the heat emission amount $T_a \times F_a$ for unit area of the heat exchanging pipe 102 by using equation (2), and finally the obtained unit area heat emission amount $T_a \times F_a$ is introduced into equation (3) to obtain a total heat transfer ratio $\alpha_a$ at the air side.

$$\begin{aligned} Q_a &= \Sigma \alpha i \times (Ti - T_a) \times F_i \\ &= \Sigma \alpha_{fL} \times (T_f L_i - T_a) \times F_f L_i + \\ &\quad \Sigma \alpha_{fS} \times (T_f S_i - T_a) \times F_f S_i + \\ &\quad \Sigma \alpha_t \times (T_{ti} - T_a) \times F_{ti} \\ &= \Sigma \alpha_j \times (T_W - T_j) \times F_j, \end{aligned} \tag{1}$$

where $\alpha i$ represents a heat transfer ratio at :he various portions i of the heat exchanging apparatus in contact with the air, which are, in sequence, selected as the heat transfer ratio $\alpha_{fL}$ at the louver portions, the heat transfer ratio $\alpha_{fS}$ at the non-louver portions and the heat transfer ratio $\alpha_t$ at the surface of the heat transfer pipe. Ti represents the temperature at various portions of the heat exchanging apparatus contacting the air, which are, in sequence, selected as the surface temperature $T_f L_i$ at the straight portion 111, the surface temperature $T_f S_i$ at the curved end 110, and the surface temperature $T_{ti}$ at the heat exchanging pipe 102. $F_i$ represents the surface area at various portions of the heat exchanging apparatus contacting the air, which are, in sequence, selected as the area $F_f L_i$ of the straight portion 111, area $F_f S_i$ of the curved portion 110. Similarly, $\alpha_j$ is heat transfer ratio at various portions of the surface contacting the water, and is selected in sequence as values of the heat transfer ratio of portions of the heat exchanging pipe along the length of the heat exchanging pipe. $T_j$ is the temperature of the surface of the heat exchanging pipe contacting the water, and is selected in sequence as values of the heat temperature at portions of surface of the heat exchanging pipe contacting the water along the length of the heat exchanging pipe. $F_j$ is the area of the surface of the pipe contacting the water, and is selected in sequence as value of the portions of the area of the surface of the heat exchanging pipe contacting the water.

$$K_a + F_a = \frac{Q_a}{(T_W - T_a)} \tag{2}$$

In the equation (2), $K_a$ is the heat transfer ratio from the water side to the air side, and $F_a$ is the sum of the air heat emission area of the heat exchanging device on the air side which is equal to $F_{fL} + F_{fS} + F_t$.

$$\frac{1}{K_a \times F_a} = \frac{1}{\alpha_a \times F_a} + \frac{1}{\alpha_W \times F_W} \tag{3}$$

In the equation (3), $\alpha_W$ is the total air transfer ratio on the water side surface, and $F_W$ is the total heat receiving area on the surface at the water side. Thus, the term, $$\frac{1}{K_a \times F_a}$$

is considered as the heat resistance in general for the heat exchanging device, the term, $$\frac{1}{\alpha_a \times F_a}$$

is, considered as a heat resistance from the heat exchanging pipe to the atmospheric air, and the term, $$\frac{1}{\alpha_W \times F_W}$$

is considered as the heat resistance from the water to the heat exchanging pipe. It should be noted that in the equation (3), the term related to the thickness of the heat exchanging pipe 101 is neglected since its effect is negligibly smaller than that of the other terms.

Figure 9A:
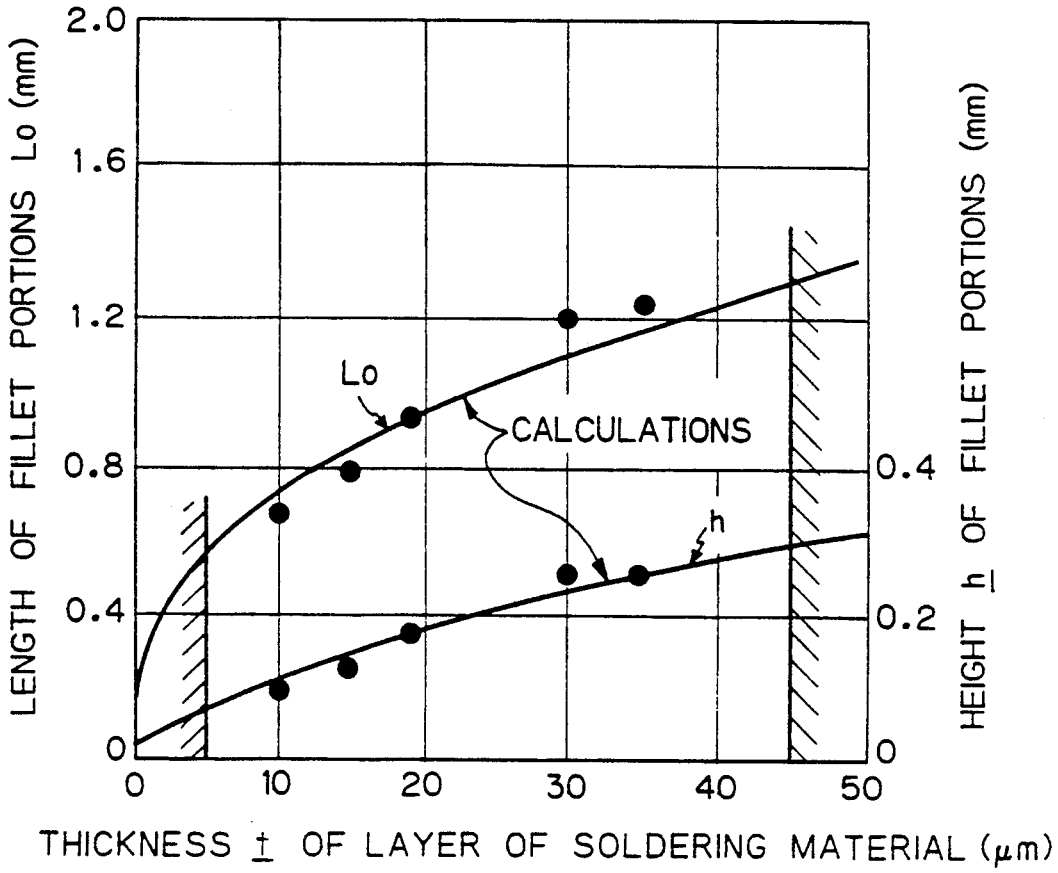
FIGS. 9A and 9B shows relationships of the thickness of the soldering material layer t to a length $L_0$ and height h of a fillet portion.
Figure 9B:
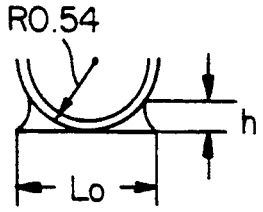

It should be noted that the shape of the fillet portions 104 is calculated based on graphs as shown in FIG. 9. Namely, FIG. 9 shows an experimental relationship of the height h (mm) and the length $L_0$ (mm) of the fillet portion 104 with respect to the thickness t (μm) of the layer 2-1 (FIG. 1) of the soldering material prior to the connection of the fins to the surface of the heat exchanging pipe. Thus, from a value of the thickness t of the soldering material layer, values of the length $L_0$ and the height h of the fillet can be estimated.

Figure 10:
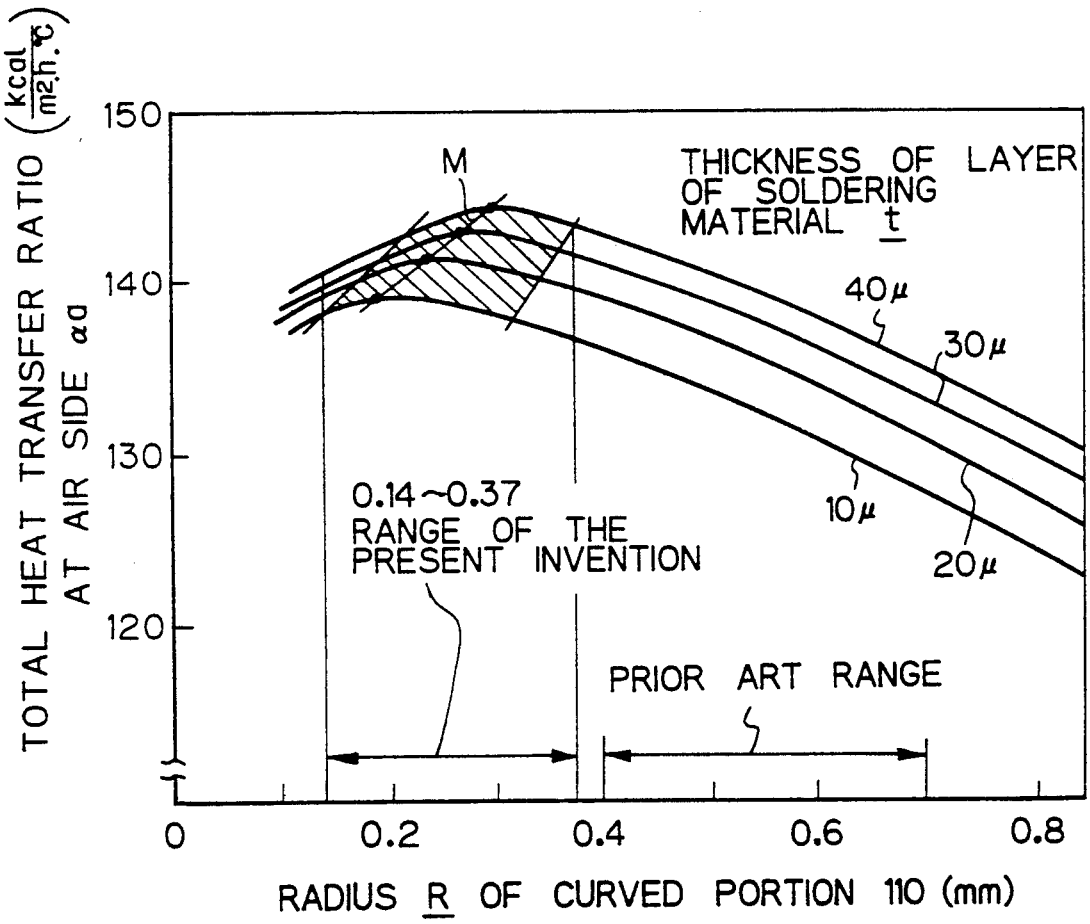
FIG. 10 shows the relationship between the radius of the curved portion of the fin and heat transfer ratio $\alpha_a$ at the air side with respect to various values of thickness of the layer of the soldering material.

As a result of the numerical analysis based on the finite elemental analysis, relationships as shown in FIG. 10 are obtained between the radius R of the bent portion 110 and the total heat transfer ratio $\alpha_a$ on the atmosphere side with respect to various values of the thickness t of the layer 2-1 of the soldering material. As easily seen from these relationships, there exist values of the radius R of the bent portion 110, which make the total heat transfer ratio $\alpha_a$ on the atmosphere side assume the respective maximum values. A line M in FIG. 10 indicates how these maximum points move with respect to the change in the values of the thickness t of the layer 2-1 of the soldering material. Namely, the larger the thickness t of the layer 2-1 of the soldering material, the larger the value of radius R of the bent portion 110 for obtaining the maximum value of the total heat transfer ratio $\alpha_a$ on the atmosphere side.

In FIG. 10, the range of the value of the radius R of the bent portion 110 as shaded corresponds to a range wherein the value of the total heat transfer ratio $\alpha_a$ on the atmospheric air side is within a one percent reduction from the maximum value for the respective values of the thickness t of the layer 2-1 of the soldering material. Namely, within a range of the value of the thickness t of the layer 2-1 of the soldering material between 10 to 40 μm, which is practically used, a value of the value of radius R of the bent portion 110 in a range between 0.14 to 0.37 mm can obtain a desired, large value of the total heat transfer ratio $\alpha_a$ on the atmosphere side. It should be noted that, in the prior art (FIGS. 1 to 4), the value of radius R of the bent portion 110 is in a range between 0.4 to 0.7 μm, which can decrease the value of the total heat transfer ratio $\alpha_a$, which accordingly decreases heat transfer efficiency.

It should be noted that the above mentioned numerical analysis is generally obtained based on an assumption that the length of the fillet portion 104 is 0.9 mm, the surface distance $H_f$ between the adjacent heat exchanging pipes 102 is 8 mm, the thickness of the heat exchanging pipe 101 is 0.13 mm, the angle $\theta$ corresponding to the raised height of the louver 103 is 23°, the speed of the atmospheric air flow is 4 m/s, and the pitch $P_f$ of the corrugated fin 101 is 2.25 mm. However, it is the inventor's finding that these factors other than the thickness of t of the layer 2-1 of the soldering material are less effective with respect to the change in the value of the total heat transfer ratio $\alpha_a$ on the atmosphere side, which is caused by the change in the value of radius R of the bent portion 110. In other words, substantially the same result as shown in FIG. 10 is obtained even if the above factors other than the thickness t of the layer of the soldering material were changed within the range of a usual design change.

It is important in the present invention that the louvers 103 extend along the full length of the straight portion 111 of the fin 101. However, substantially the same result is obtained if the louver has a length which is slightly shorter than the full length of the straight portion 111.

The length $L_0$ of the fillet portion 104 depends mainly on the radius R of the bent portion 111, and it is assumed that a limitless reduction in the radius R of the bent portion 111 allows the excessive soldering material to be flown out, so that fillet portion 104 is formed only at the boundaries between the bent portion 110 and the straight portion 111. It should be also noted that the length $L_0$ of the fillet portion 104 also depends to the thicknesses of the layer 2-1 of the soldering material. Namely, the larger the thickness of the layer of the soldering material, the larger the length $L_0$ of the fillet portion 104 irrespective of the fact that the radius R of the bent portion 111 is maintained unchanged.

Figure 11:
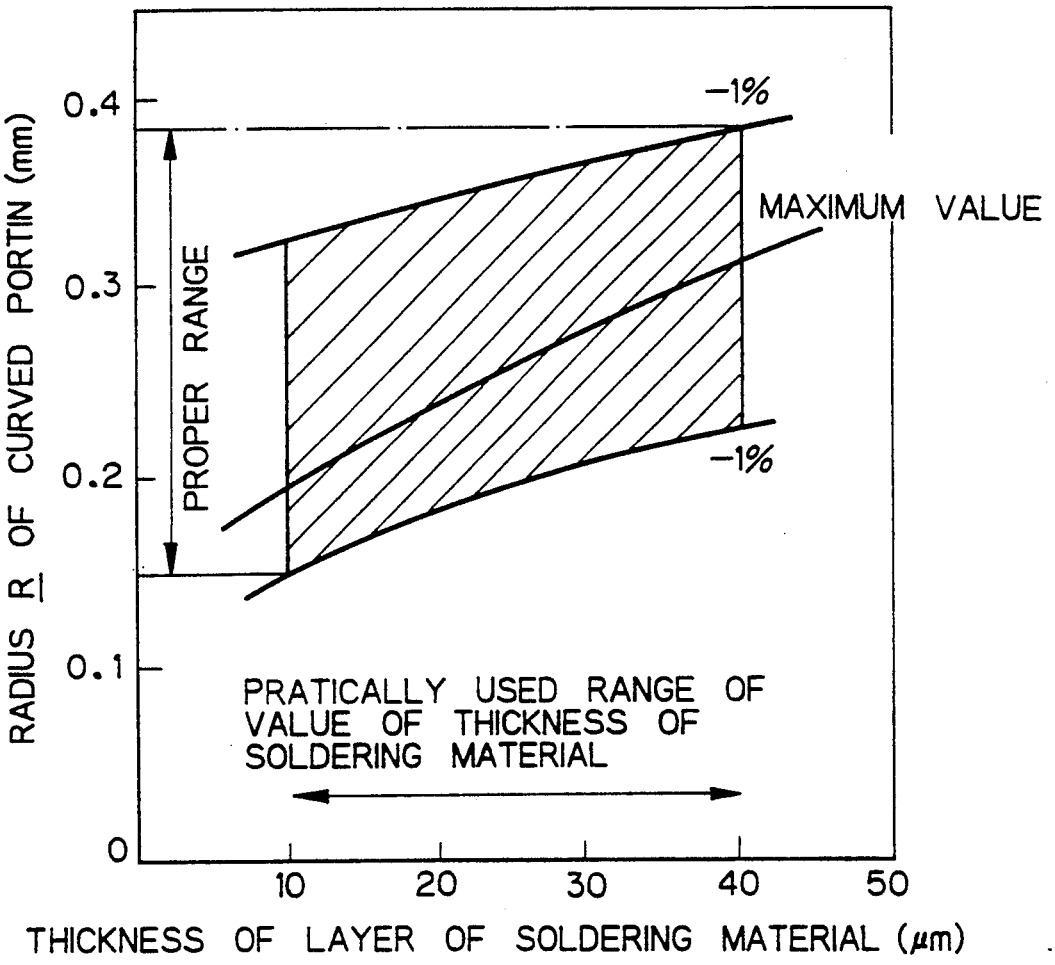
FIG. 11 shows a curve providing the maximum value of the heat transfer ratio $\alpha_a$ at the air side with respect to the thickness of the soldering material layer and the radius of the curved end portion of the fin, together with curves for obtaining a 1 percent reduced value of the heat transfer ratio $\alpha_a$.

FIG. 11 shows, with respect to the practical range of the thickness of t of the layer 2-1 of the soldering material, a desired range of the radius R of the bent portion 111 (shaped area), which can provide values of the total heat transfer ratio $\alpha_a$ on the atmosphere side which are within a range of one percent reduction from the maximum value M of the total heat transfer ratio $\alpha_a$. It should be noted that the one percent reduction of the heat transfer ratio $\alpha_a$ on the atmospheric air side corresponds to a reduction of the heat transfer amount of about 0.5 percent, and therefore it is considered that the radius of the curved portion in this range can provide the same effect as that of the radius which provides the maximum value of $\alpha_a$.

Figure 12:
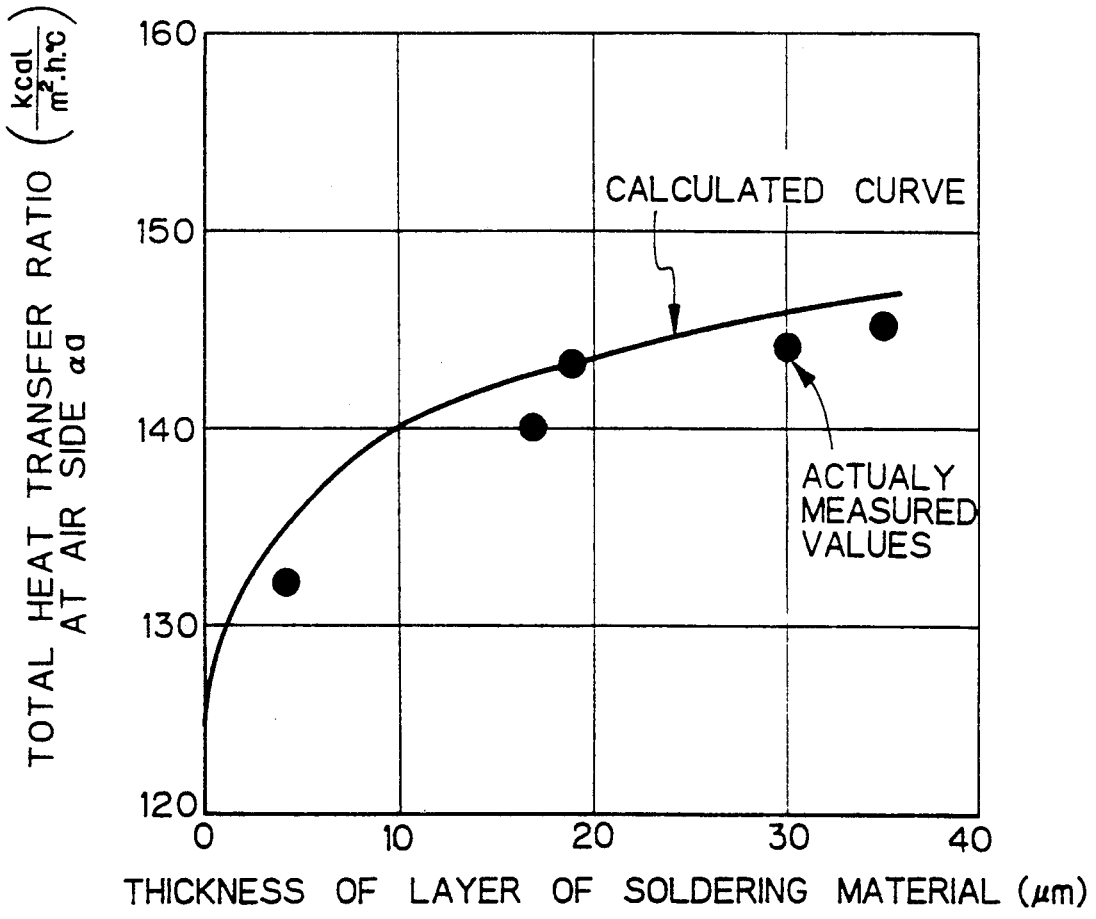
FIG. 12 shows a curve between the thickness of the coating of the soldering material and the heat transfer ratio $\alpha_a$ at the air side together with experimentally obtained values.

In FIG. 12, a line shows a theoretically calculated value of $\alpha_a$, based on the above mentioned finite elementary analysis, while assuming that the radius of the curved portion is one which provides the most appropriate value for the selected thickness of the layer of the soldering material. There is good conformity between the calculation result and the test result.

We claim:

1. A heat exchange apparatus comprising:

first and second heat exchange pipes spaced apart and substantially parallel to one another, said heat exchange pipes for carrying a first fluid medium therethrough;

a corrugated fin connecting a flat surface of said first heat exchange pipe to a flat surface of said second heat exchange pipe, said corrugated fin being in communication with a second fluid medium and permitting heat exchange between the first fluid medium and the second fluid medium;

said fin having first curved portions and second curved portions making contact with the flat surface of said first heat exchange pipe and said second heat exchange pipe respectively, said first and second curved portions having a radius in the range of about 0.14 mm to 0.37 mm, said radius being substantially constant along a width of the fin;

said fin having straight portions extending between the first and second curved portions, said straight portions having at least one louver disposed on a surface thereof, said at least one louver extending from said first heat exchange pipe toward said second heat exchange pipe; and fillet portions comprising a soldering material rigidly connecting the first curved portions and the second curved portions with the flat surface of the first heat exchange pipe and the second heat exchange pipe respectively.

2. A heat exchange apparatus as claimed in claim 1, wherein the first and second heat exchange pipes and the corrugated fin are made of an aluminum based alloy material.

3. A heat exchange apparatus as claimed in claim 1 wherein the fillet portion has a length in a range from about 0.1 mm to 0.3 mm.

4. A heat exchange apparatus as claimed in claim 1 wherein each said at least one louver comprises a slit raised portion of one of said straight portions.

5. A heat exchange apparatus comprising:

a plurality of heat exchange pipes spaced apart and substantially parallel to one another, said heat exchange pipes for carrying a first fluid medium therethrough;

a plurality of corrugated fins, at least one of said corrugated fins being disposed between a flat surface of a first of said heat exchange pipes and a flat surface of a second of said heat exchange pipes, said at least one corrugated fin being in communication with a second fluid medium and permitting heat exchange between the first fluid medium and the second fluid medium;

said at least one fin having first curved portions and second curved portions making contact with the flat surface of said first heat exchange pipe and said second heat exchange pipe respectively, said first and second curved portions having a radius in the range of about 0.14 mm to 0.37 mm, said radius being substantially constant along a width of said at least one fin;

said at least one fin having straight portions extending between the first and second curved portions, said straight portions having at least one louver disposed on a surface thereof, said at least one louver extending from said first heat exchange pipe toward said second heat exchange pipe; and fillet portions comprising a soldering material rigidly connecting the first curved portions and the second curved portions with the flat surface of the first heat exchange pipe and the second heat exchange pipe respectively.

6. A heat exchange apparatus as claimed in claim 5, wherein the heat exchange pipes and the corrugated fins are made of an aluminum based alloy material.

7. A heat exchange apparatus as claimed in claim 5, wherein the fillet portion has a length thereof in a range from about 0.1 mm to 0.3 mm.

8. A heat exchange apparatus as claimed in claim 5 wherein each said at least one louver comprises a slit raised portion of one of said straight portions.

9. A method for assembling a heat exchanging apparatus, said method comprising the steps of:

providing first and second heat exchange pipes spaced apart and substantially parallel to one another, said heat exchange pipes for carrying a first fluid medium therethrough;

providing a corrugated fin disposed between a flat surface of said first heat exchange pipe and a flat surface of said second heat exchange pipe, said fin having first curved portions making contact with the flat surface of said first heat exchange pipe and second curved portions making contact with the flat surface of said second heat exchange pipe, said first and second curved portions having a substantially constant radius in the range of about 0.14 mm to 0.37 mm along a width of the fin, said fin having straight portions extending between the first and second curved portions, said straight portions having at least one louver disposed on a surface thereof and extending from said first heat exchange pipe toward said second heat exchange pipe, said corrugated fin being in communication with a second fluid medium and permitting heat exchange between the first fluid medium and the second fluid medium; and heating the first and second heat exchange pipes to melt a solder material disposed thereon so that melted solder material is gathered at a junction where the first curved portions and the second curved portions meet the flat surface of the first and second heat exchange pipes respectively, said melted solder material solidifying to form fillet portions rigidly connecting the first and second curved portions to the flat surface of the first and second heat exchange pipes respectively.

10. The method as claimed in claim 9, wherein the solder material has a thickness in a range of about 10 μm to 40 μm.

* * * * *